US008176703B2

(12) United States Patent
Tremacchi

(10) Patent No.: US 8,176,703 B2
(45) Date of Patent: May 15, 2012

(54) SHELTER STRUCTURE, IN PARTICULAR FOR ELECTRICAL EQUIPMENTS

(75) Inventor: Alfredo Tremacchi, Brescia (IT)

(73) Assignee: Smitt Carpenteria S.r.l., Roncadelle, Brescia (IT)

( * ) Notice: Subject to any disclaimer, the term of this patent is extended or adjusted under 35 U.S.C. 154(b) by 180 days.

(21) Appl. No.: 12/305,052

(22) PCT Filed: Jun. 16, 2006

(86) PCT No.: PCT/IT2006/000455

§ 371 (c)(1),
(2), (4) Date: Mar. 23, 2009

(87) PCT Pub. No.: WO2007/144913

PCT Pub. Date: Dec. 21, 2007

(65) Prior Publication Data

US 2009/0205276 A1 Aug. 20, 2009

(51) Int. Cl.
*E04H 12/00* (2006.01)

(52) U.S. Cl. ..... 52/655.1; 52/656.9; 403/171

(58) Field of Classification Search ..... 52/79.1, 52/282.1, 282.2, 262, 264, 270, 656.9, 655.1; 403/169–178, 217–218, 331, 252, 255
See application file for complete search history.

(56) References Cited

U.S. PATENT DOCUMENTS

| | | | | |
|---|---|---|---|---|
| 3,143,165 | A | 8/1964 | Lewis et al. | |
| 3,416,270 | A * | 12/1968 | McHugh | 248/687 |
| 5,066,161 | A * | 11/1991 | Pinney | 403/172 |
| D362,509 | S * | 9/1995 | Russell | D25/61 |
| 5,451,115 | A * | 9/1995 | Sayres | 403/171 |
| 5,647,181 | A * | 7/1997 | Hunts | 52/282.1 |
| 6,030,063 | A * | 2/2000 | Benner | 312/265.1 |
| 7,883,288 | B2 * | 2/2011 | Jorna | 403/171 |
| 2003/0024173 | A1 * | 2/2003 | Cohen | 52/79.1 |
| 2005/0034390 | A1 | 2/2005 | Dubensky et al. | |
| 2005/0144857 | A1 | 7/2005 | Guerrero | |

FOREIGN PATENT DOCUMENTS

| | | |
|---|---|---|
| DE | 4009189 | 9/1991 |
| EP | 0182288 | 5/1986 |
| EP | 1312729 | 5/2003 |
| FR | 2193408 | 2/1974 |

* cited by examiner

*Primary Examiner* — Brian Glessner
*Assistant Examiner* — Gisele Ford
(74) *Attorney, Agent, or Firm* — Shoemaker and Mattare

(57) ABSTRACT

The object of the present invention is a shelter structure, in particular for electrical equipment, totally modular, simple and inexpensive to make, and extremely quick to assemble, also on the place of use. Such structure comprises angular connecting joints (11), horizontal bars (13) and vertical uprights (14) that connect to said joints, and a series of panels (16, 17) of suitable materials suitable for forming the walls, the roof and the floor of the structure.

8 Claims, 9 Drawing Sheets

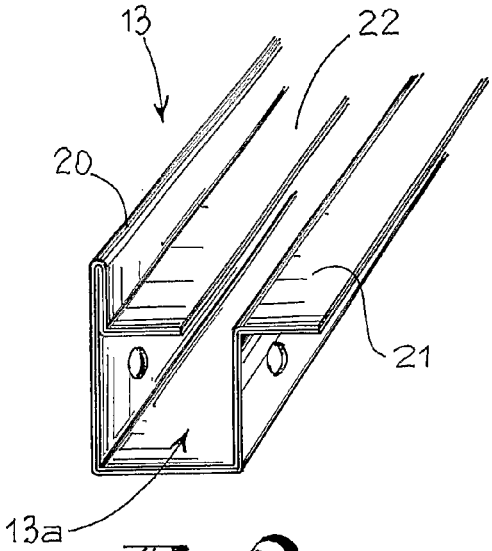
Fig.2
Fig.3
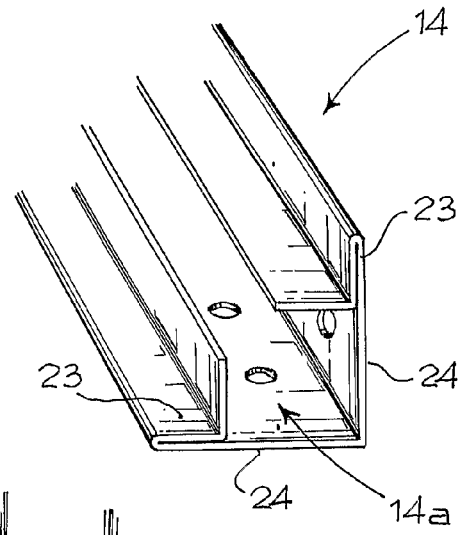
Fig.4
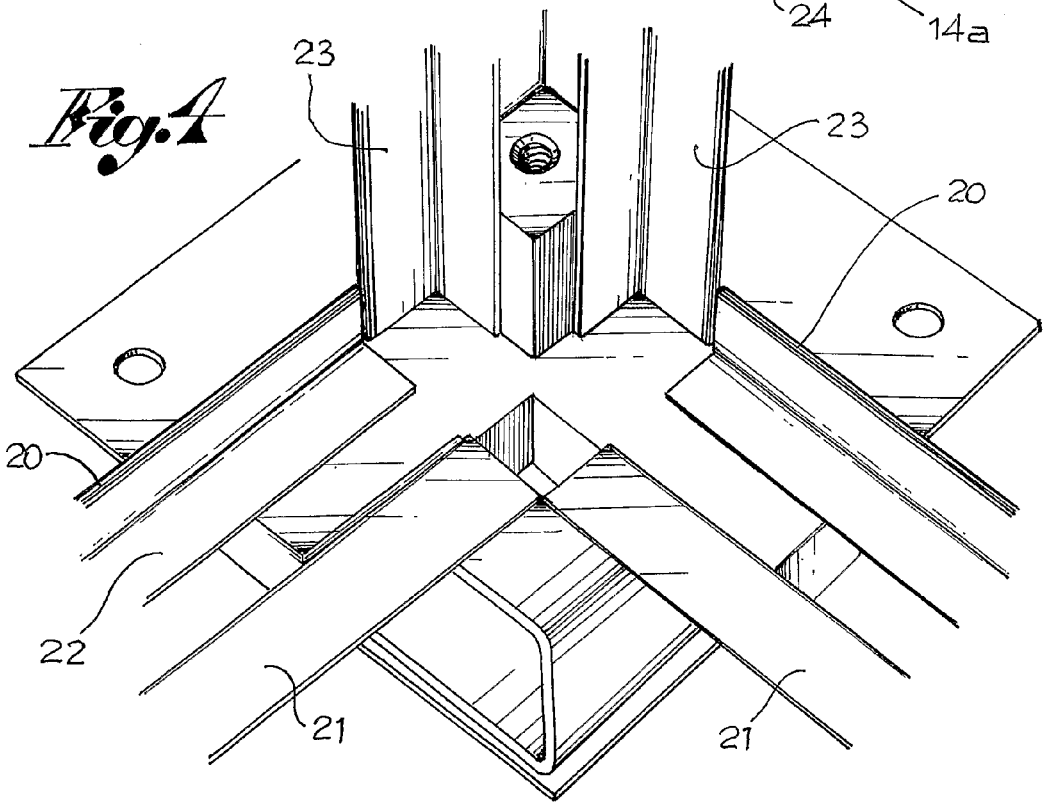

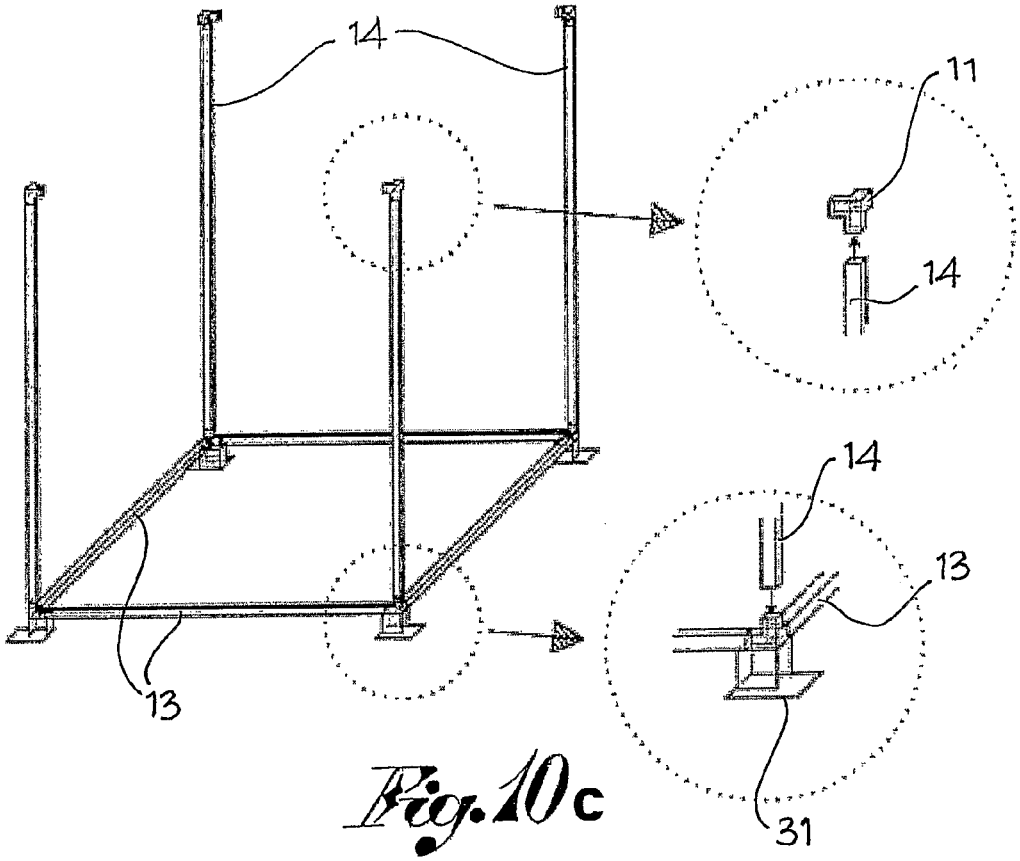
Fig. 10c
Fig. 10d
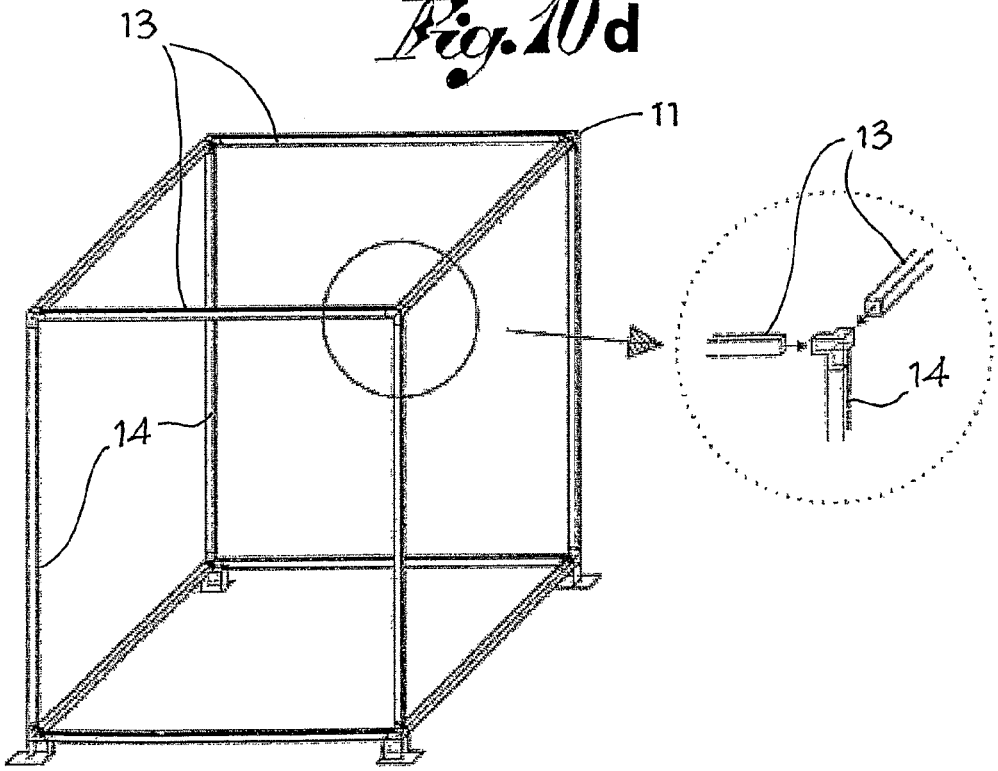

SHELTER STRUCTURE, IN PARTICULAR FOR ELECTRICAL EQUIPMENTS

The present invention relates to a shelter structure, in particular for electrical equipment, for example of telecommunication systems.

More in detail, the invention relates to a shelter with modular structure, that is, comprising a series of elements that can be assembled with one another, also on site, so as to obtain shelters of different sizes, according to the needs.

Shelters with modular or sectional structure have already been proposed. Reference shall be made, for example, to documents FR2193408, EP1312729, US2005/0144857. Such structures, however, consist of a large number of parts, with an even complex structure, and therefore are disadvantageous from the point of view of production and storage costs, besides requiring long assembly times.

For such reasons, the most widespread and used are still the shelters with structure welded at the factory, to be carried already finished to the place of use, with all the related disadvantages.

The object of the present invention is to propose a modular shelter structure particularly simple and inexpensive to manufacture and handle, extremely quick to assemble and with the utmost functionality.

Such object is achieved with a shelter structure according to claim 1.

The details and advantages of the structure according to the invention will appear clearly from the following description of a preferred embodiment thereof, made by way of an indicative non-limiting example with reference to the annexed drawings, wherein:

FIG. 2 shows a perspective view of a horizontal bar of the structure;

FIG. 3 shows a perspective view of a vertical upright of the structure;

FIG. 4 shows an angular joint on which there are fitted two horizontal bars and a vertical upright;

FIGS. 10*a*-10*i* schematically show as many assembly steps of the structure.

Figure 10A:
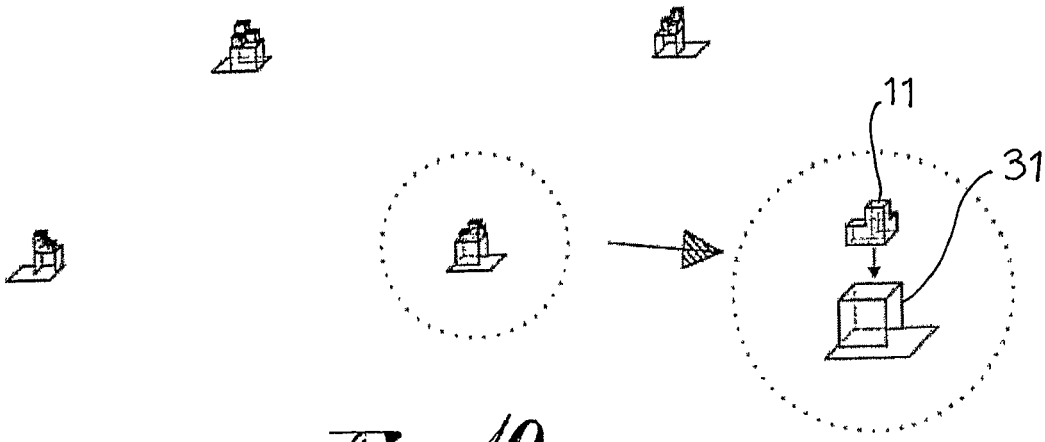
Figure 10B:
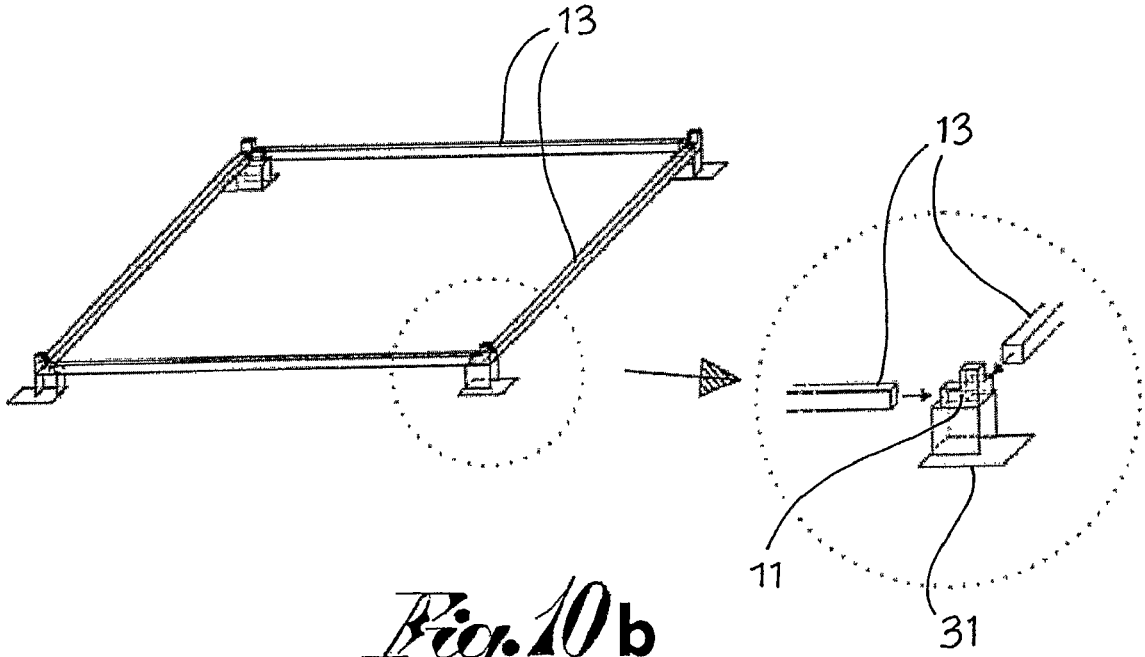
Figure 10E:
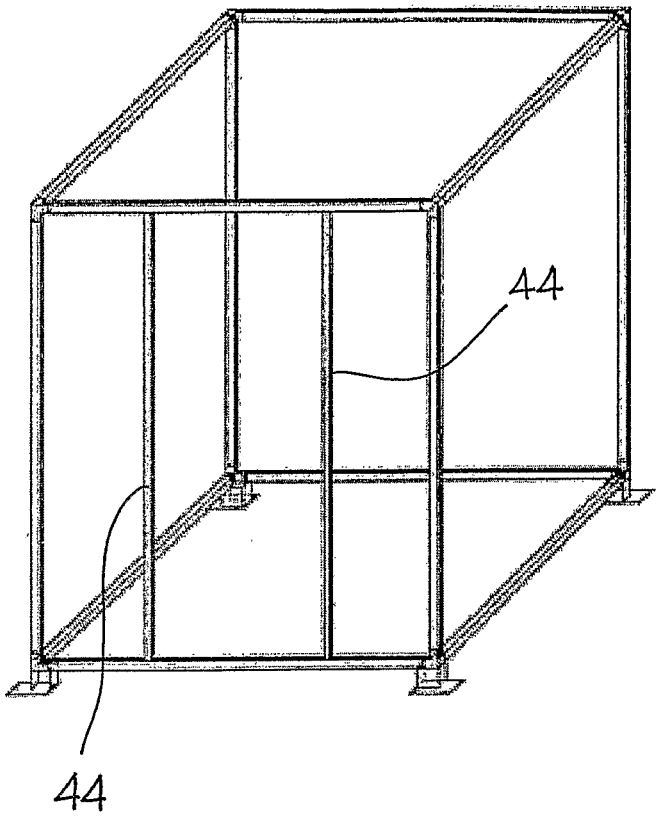
Figure 10F:
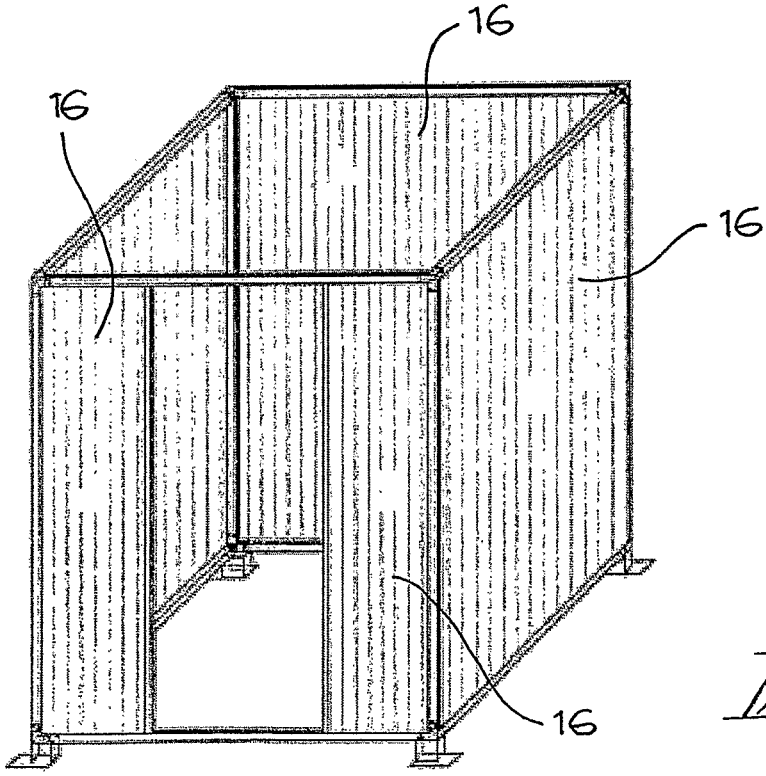
Figure 10G:
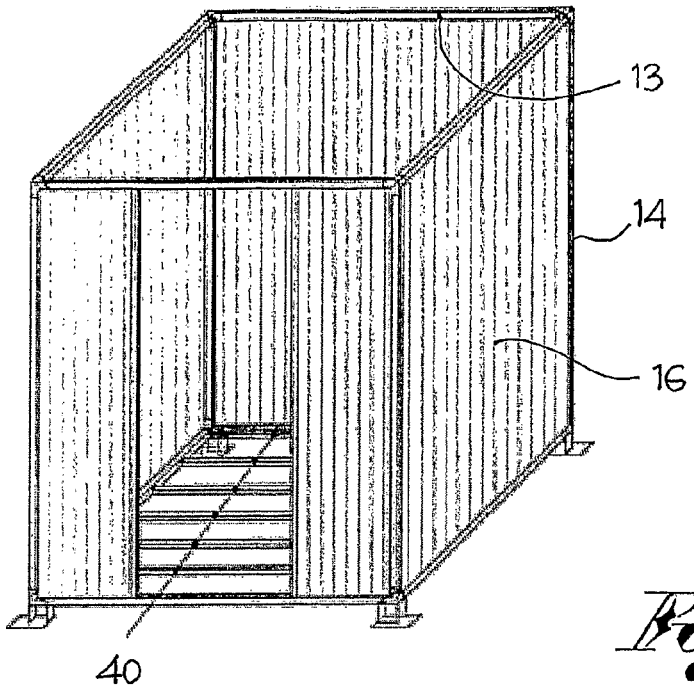
Figure 10I:
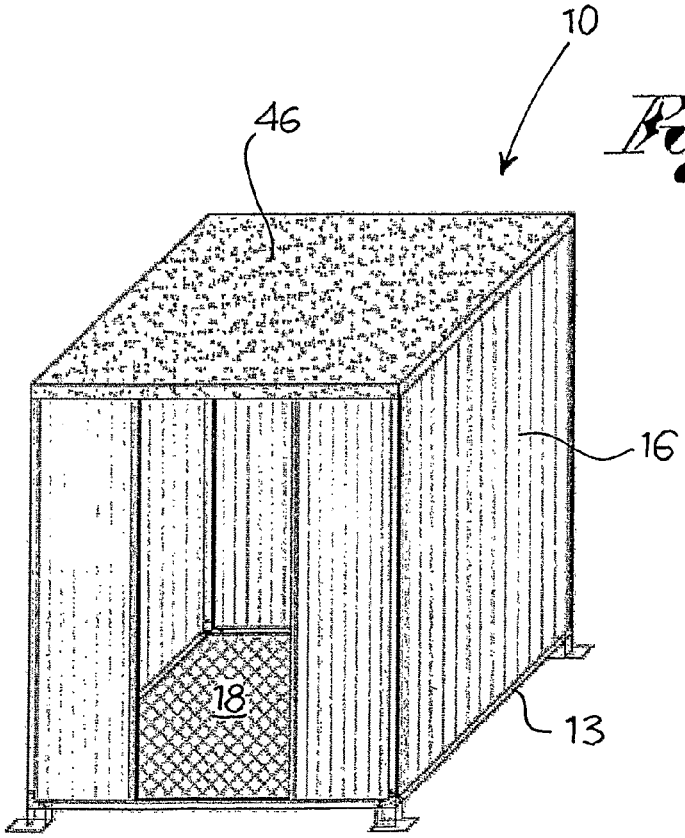

The shelter structure according to the present invention, particularly suitable for seating electrical equipment, comprises a series of components that can be assembled with each other for forming a parallelepipedal structure, globally indicated with reference numeral 10 in FIG. 10*i*.

The vertexes of such parallelepipedal structure are made of angular connecting joints 11. Each of said angular joints 11 is provided with three arms 12, 12' orthogonal to one another that extend in the three directions of space x, y and z. In particular, for each joint of the structure it is possible to distinguish between two horizontal arms 12 that extend in a horizontal plane in the two orthogonal directions x and y, and a vertical arm 12' that extends perpendicularly to said horizontal plane, along direction z.

Preferably, said arms 12, 12' have a rectangular section.

The shelter structure further comprises a series of horizontal hollow bars 13 suitable for being fitted at the ends on the horizontal arms 12 of said angular joints 11 and a series of vertical hollow uprights 14 suitable for being fitted at the ends on the vertical arms 12' of said joints. Cavity 13*a*, 14*a* of said bars 13 and uprights 14 preferably exhibits such rectangular section as to geometrically couple with the section of the joint arms.

The structure finally comprises a plurality of rectangular panels 16, 17 and 18 suitable for respectively forming the walls, the ceiling and the floor of the shelter.

Each horizontal bar 13 has longitudinally, that is, in the direction of the horizontal extension thereof and, preferably, for the entire length thereof, an external vertical shoulder 20 for supporting the vertical panels 16 acting as walls of the structure.

Each of said horizontal bars 13 further defines a horizontal shelf 21 for supporting the horizontal panels 18 acting as floor or horizontal panels 17 acting as roof (according to whether it is a bar of the perimeter of the base or of the ceiling of the structure).

In other words, each horizontal bar 13 concurrently acts as support element for the structure walls and as support element for the floor or the roof.

In accordance with a preferred embodiment, each of said horizontal bars 13 is obtained from a sheet cut and bent so as to obtain a U profile, wherein an end portion of the external vertical wall is further bent once internally backwards, that is, by 180°, for defining said vertical shoulder 20, and a second time horizontally inwards for delimiting and closing at least partly cavity 13*a* of the bar, imparting the desired shape and dimension to such cavity.

In other words, the external vertical side of bar 13 at the top defines a square profile, whose horizontal portion 22 acts as support plane on the horizontal arms 12 of the angular joints 11.

An end portion of the internal vertical wall of bar 13 is further bent horizontally outwards for defining shelf 21.

Advantageously, at least the horizontal arms 12 of each angular joint 11 exhibit an end for the insertion into cavity 13*a* of the horizontal bars of reduced section, so as to define a peripheral shoulder 12*a* of axial abutment for the ends of said bars 13.

Each vertical upright 14 exhibits longitudinally, preferably for the entire extension thereof, two vertical shoulders 23 for supporting respective vertical panels 16 acting as walls.

In accordance with a preferred embodiment, each upright 14 is obtained from a sheet cut and bent so as to obtain two vertical orthogonal walls 24, and wherein an end portion of each of said walls is further bent once internally backwards, that is, by 180°, for defining said vertical support shoulder 23, and a second time parallel to the other of said walls for delimiting and closing at least partly cavity 14*a* of said upright, imparting the desired shape and dimension thereto.

In other words, each of the vertical walls 24 orthogonal to one another ends with a square profile that, at the ends thereof, and with mounted structure, abuts on the base of the horizontal arms 12, imparting stability to the structure. It should be noted that the vertical shoulders 23 of uprights 14 are aligned to vertical shoulders 20 of the horizontal bars 13 so as to define a rectangular support frame therewith for panels 16 acting as structure wall.

In accordance with an embodiment, bars 13 and uprights 14 are further secured to the angular joints 11 by cross screws that connect the end portions of said bars and uprights to the respective arms of the joints.

According to a preferred embodiment, each angular joint 11 exhibits, coaxially to the vertical arm 12', a threaded hole 11*a* open at least on the face opposite said vertical arm for a coupling screw 30 of the joint alternatively to a foot 31 for the structure support on the ground or a ring 32 for lifting and carrying the shelter.

In other words, and advantageously, the same angular joint 11 can be used both for making the structure base raised from the ground, and for the structure roof, provided with means for lifting thereof.

In the case of rectangular structures of a certain length, the horizontal bars 13 of the opposite sides of greater length than the structure base can be connected by intermediate horizontal bars 40 having such a Ω section as to allow the support of multiple panels 18 acting as floor.

Figure 1:
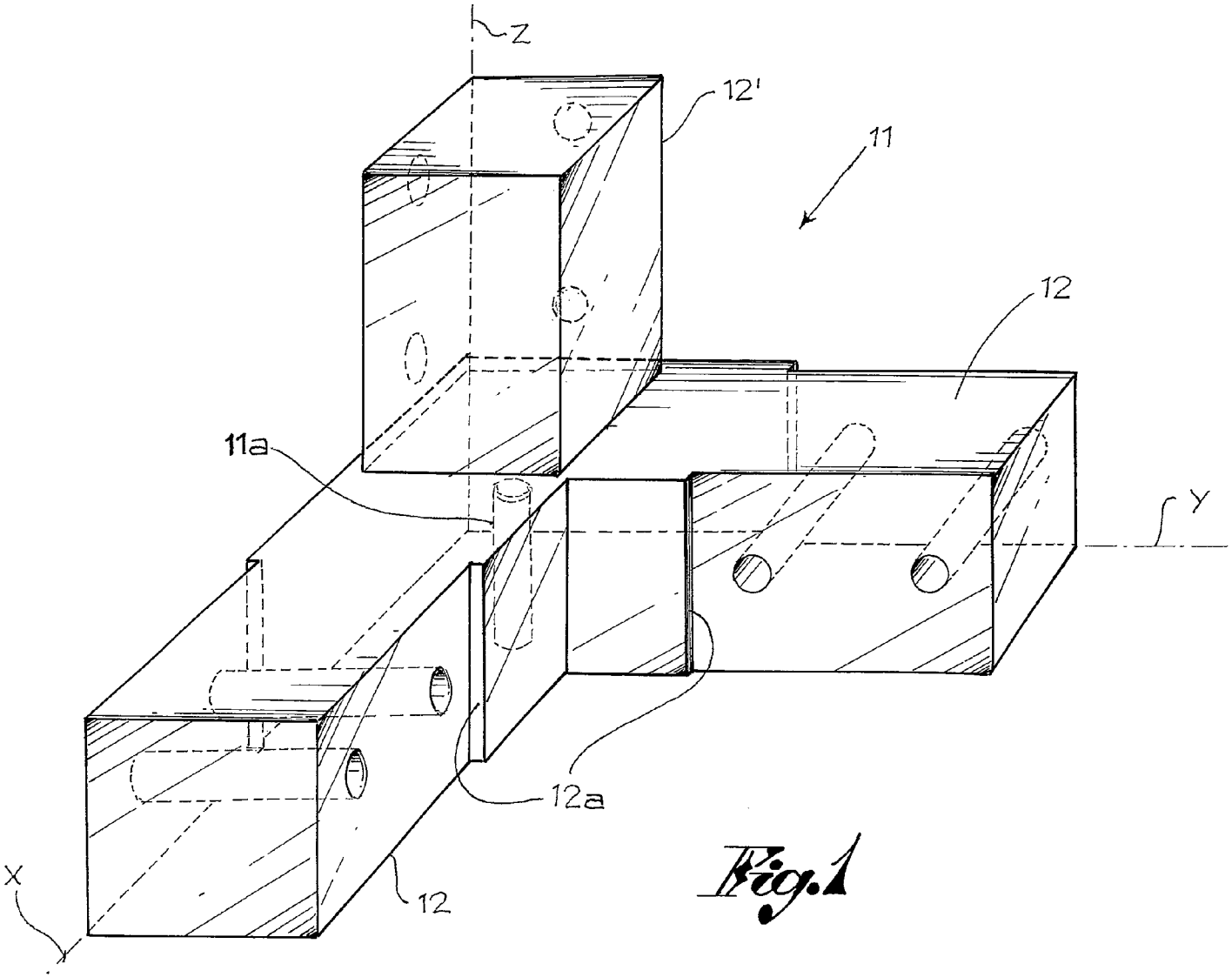
FIG. 1 shows a perspective view of an angular joint of the shelter structure according to the invention.
Figure 5:
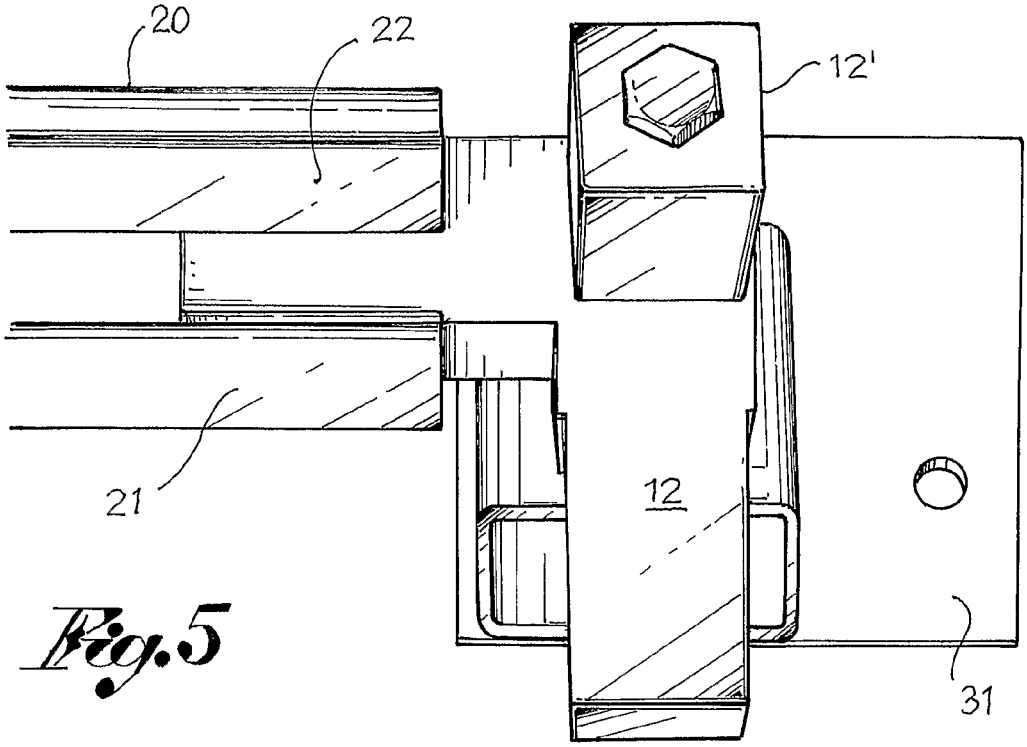
FIG. 5 shows a top view of the angular joint and of a relevant horizontal bar.
Figure 6:
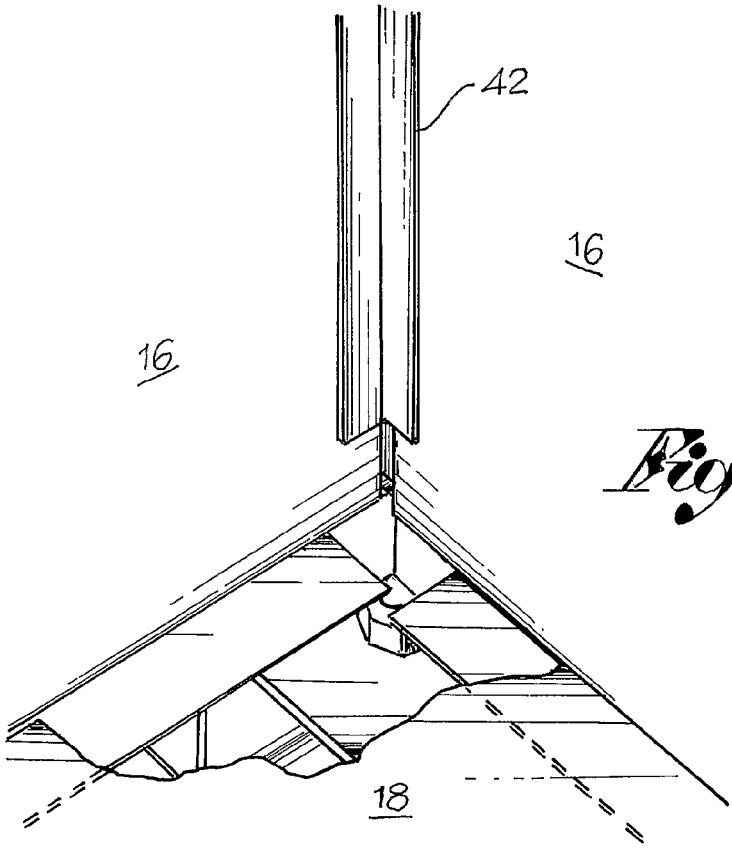
FIG. 6 shows a perspective view of an internal corner of the assembled structure.
Figure 7:
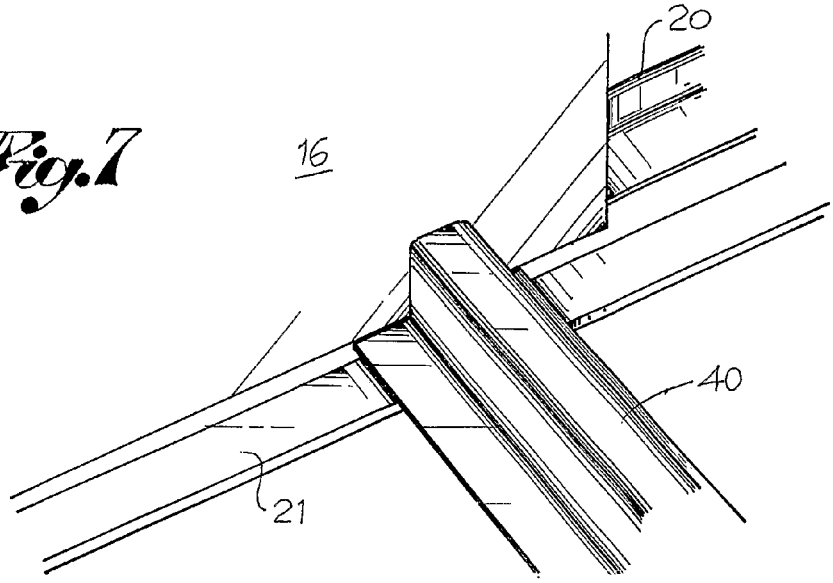
FIG. 7 shows an intermediate horizontal bar for supporting the floor.
Figure 8:
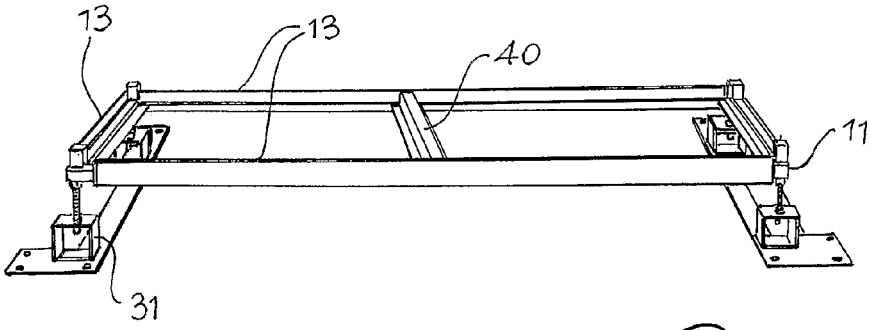
FIG. 8 shows a view of the base of the assembled structure.
Figure 9:
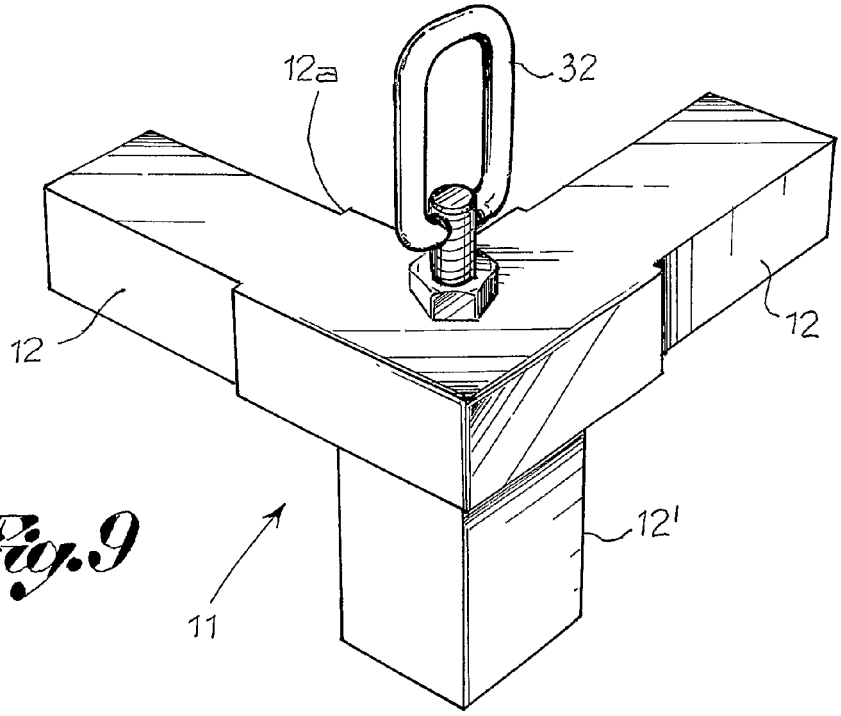
FIG. 9 shows a view of a vertical joint for the top of the structure.

In accordance with an embodiment, adjacent vertical panels 16 are connected to one another by vertical bars 42 shaped as an L to be arranged in the internal corners of the structure, between two adjacent panels, and suitable for being attached to said panels for example by rivets (FIG. 6).

Finally, the shelter structure comprises a pair of vertical bars 44, for example with a C section, suitable for making the frame for a door.

The shelter carrying structure, that is, joints, bars and uprights, preferably is of hot-galvanised steel. The walls and the roof are made of rolled panels 16, 17 having the outer surface consisting of a coated and galvanised plate, with an intermediate layer of self-extinguishing polyurethane foam.

Panels 17 of the roof have the same features as panels 16 of the walls and can be externally coated with a steel plate 46. The roof can be further obtained with corrugated panels, for example in the case of shelter installation in the proximity of the sea.

Moreover, in order to facilitate the water drainage, panels 17 that make the roof ensure a minimum slope of 2%.

The floor is made with multilayer wooden panels and is internally finished with a linoleum coating.

The simplicity of assembly of the structure is clear from the description of the assembly steps given hereinafter with reference to FIGS. 10*a*-10*i*.

At first, each angular joint 11 is attached to a respective foot 31 (FIG. 10*a*).

The structure base perimeter is then formed, fitting the horizontal bars 13 on the horizontal arms of the angular joints (FIG. 10*b*).

The vertical uprights 14 are then placed on the vertical arms of the base angular joints, after which the angular joints of the roof are inserted in the top of the uprights (FIG. 10*c*).

The structure roof perimeter is then formed, fitting the horizontal bars 13 on the arms of the roof angular joints (FIG. 10*d*).

At this point, the C-shaped vertical bars 44 defining the door frame can be applied (FIG. 10*e*).

After that, panels 16 forming the structure walls are applied (FIG. 10*f*).

The intermediate horizontal bars 40 are then laid for supporting panels 18 of the floor (FIG. 10*g*).

Figure 10H:
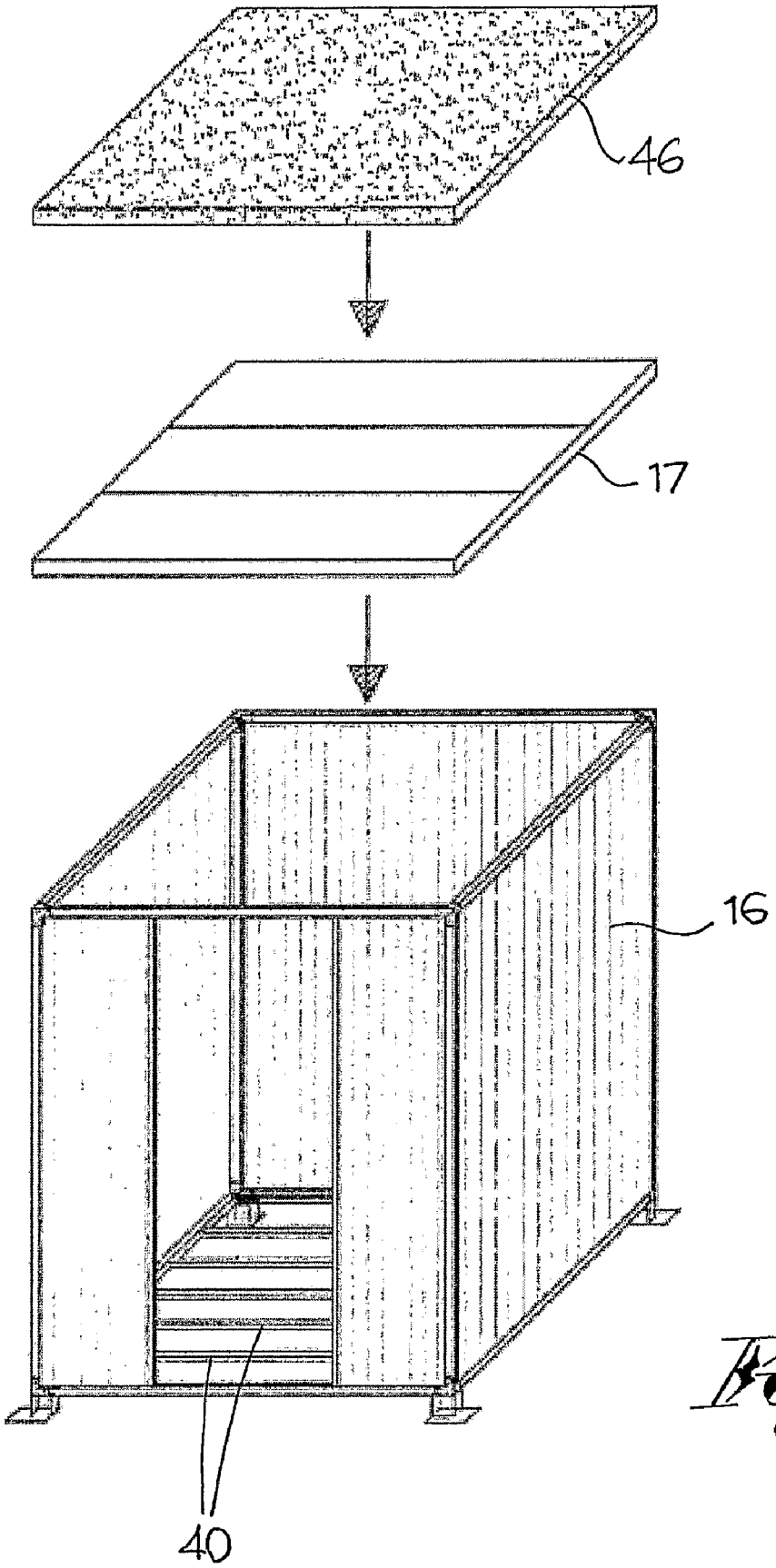

Panels 17 and the coating plate 46 are then laid for forming the structure roof (FIG. 10*h*).

Finally, panels 18 acting as floor with the optional linoleum coating are applied.

The advantages of the shelter structure described above are clear.

The structure consists of a reduced number of parts, all simple and inexpensive to make. It should be noted that the structure elements are interchangeable, that is, a same element can be used in different positions of the structure.

The shelter, based on the place of destination and on the means of transport, can be assembled and tested at the factory or assembled on site, thanks to its fully modular structure.

Such modularity and decomposability of the structure allows making shelters of different sizes, according to the needs. In particular, it is possible to change the shelter structure and size with great easiness and rapidity, even after its installation.

A man skilled in the art may make several changes, adjustments and replacements of elements with other functionally equivalent ones to the embodiments of the structure described above in order to meet incidental needs, without departing from the scope of the following claims. Each of the features described as belonging to a possible embodiment can be obtained independently of the other embodiments described.

The invention claimed is:

1. In a shelter structure comprising:

connecting joints, each having three arms orthogonal to each other, two of the arms being horizontal when a third is vertical, hollow horizontal bars having ends which fit over the horizontal arms of said joints, hollow vertical uprights having ends which fit over the vertical arms of said joints, and rectangular panels forming a floor, walls and a ceiling of said shelter structure, the improvement wherein:

each of said arms has a rectangular cross-section, each of said horizontal bars has an open profile having an external vertical wall and an internal vertical wall, the external vertical wall being extended to form an external vertical shoulder (20) and a horizontal internal flange (22) extending from the vertical shoulder for engaging one of the horizontal arms (12) of the joints (11), the internal vertical wall terminating at a horizontal shelf (21) for supporting the panels forming the floor or the ceiling, and wherein each of the vertical uprights longitudinally has two vertical shoulders (23) extending therefrom which, when the upright is installed on the joint, are aligned with the vertical shoulders (20) of the horizontal bars (13) so as to define a rectangular support frame, and the panels (16) forming the walls of the structure rest against an inner surface of said external vertical shoulders of the horizontal bars and the vertical shoulders of the vertical bars.

2. The shelter structure according to claim 1, wherein each of said horizontal bars has, an end portion of the external vertical wall bent once internally backwards to define said vertical shoulder and a second time horizontally inwards to form said internal flange, and an end portion of the internal vertical wall is further bent horizontally outward to define said shelf.

3. The shelter structure according to claim 1, wherein each of said vertical uprights has two vertical orthogonal walls, and an end portion of each of said walls is further bent once internally backwards for defining said vertical support shoulder and a second time parallel to the other of said walls to form an at least partially closed cavity of said upright.

4. The shelter structure according to claim 1, wherein at least one horizontal arm of each joint has an end portion of reduced section, so as to define an axial abutment shoulder for the ends of said bars.

5. The shelter structure according to claim 1, wherein the bars and the uprights are secured to the joints by cross screws that connect the end portions of said bars and uprights to the respective arms of the joints.

6. The shelter structure according to claim 1, wherein each joint has, coaxially to the vertical arm, a threaded hole for receiving a screw for connecting the joint alternatively to a foot for supporting the structure on the ground or a ring for lifting and carrying the shelter.

7. The shelter structure according to claim 1, further comprising L-shaped vertical bars for connecting two adjacent vertical panels acting as walls to one another.

8. The shelter structure according to claim 1, further comprising at least one Ω-shaped horizontal bar resting on the shelves of two opposite horizontal bars for supporting two adjacent horizontal panels acting as floor.

* * * * *